US007265490B2

(12) United States Patent
Yoon

(10) Patent No.: US 7,265,490 B2
(45) Date of Patent: Sep. 4, 2007

(54) PLASMA DISPLAY PANEL BUS ELECTRODE STRUCTURE

(75) Inventor: Cha-Keun Yoon, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 191 days.

(21) Appl. No.: 10/924,878

(22) Filed: Aug. 25, 2004

(65) Prior Publication Data

US 2005/0046352 A1 Mar. 3, 2005

(30) Foreign Application Priority Data

Aug. 26, 2003 (KR) ..... 10-2003-0059096

(51) Int. Cl.
*H01J 17/49* (2006.01)

(52) U.S. Cl. ..... 313/582; 313/491; 313/583

(58) Field of Classification Search ..... 313/491, 313/485, 112, 582–587
See application file for complete search history.

(56) References Cited

U.S. PATENT DOCUMENTS 5,952,782 A 9/1999 Nanto et al. ..... 313/584
6,297,590 B1 * 10/2001 Nanto et al. ..... 313/586
6,429,586 B1 * 8/2002 Nishiki et al. ..... 313/582
6,628,075 B1 * 9/2003 Kim ..... 313/586
6,949,872 B2 * 9/2005 Chang et al. ..... 313/112
2002/0070664 A1 * 6/2002 Terao et al. ..... 313/582

FOREIGN PATENT DOCUMENTS

JP 08-162028 A1 6/1996
JP 2001-084908 3/2001
JP 2001-084908 A1 3/2001
JP 2001-319584 11/2001
JP 2001319584 A * 11/2001

* cited by examiner

*Primary Examiner*—Karabi Guharay
*Assistant Examiner*—Kevin Quarterman
(74) *Attorney, Agent, or Firm*—H.C. Park & Associates, PLC

(57) ABSTRACT

A plasma display panel including a substrate with X and Y display electrodes that are disposed in parallel on an inner surface of the substrate. Bus electrodes have extended parts formed on the X and Y display electrodes, slanted parts formed along an edge of the substrate, extending from the respective extended parts and inclined with respect to the extended parts at a predetermined angle, and connecting parts extending from the slanted parts, wherein a width of at least one portion of the slanted part is greater than a width of the extended part.

8 Claims, 5 Drawing Sheets

PLASMA DISPLAY PANEL BUS ELECTRODE STRUCTURE

This application claims the benefit of Korean Patent Application No. 2003-59096, filed on Aug. 26, 2003, which is hereby incorporated by reference for all purposes as if fully set forth herein.

BACKGROUND OF THE INVENTION

1. Field of the Invention

The present invention relates to a plasma display panel (PDP), and more particularly, to a PDP with bus electrodes having slanted parts with increased widths.

2. Discussion of the Related Art

Generally, a plasma display panel (PDP) displays images using a gas discharge phenomenon. Since PDPs have excellent display characteristics such as display capacity, brightness, contrast, afterimage, and viewing angle, they have been widely used as a substitute for cathode ray tubes (CRTs). In a PDP, a direct current (DC) or an alternating current (AC) may be applied to electrodes to cause a gas between them to discharge, and radiation of ultraviolet rays due to the discharge excites a fluorescent material, thus causing light emission.

FIG. 1 shows an exploded view of a conventional AC type PDP. Referring to FIG. 1, pairs of transparent X and Y display electrodes 3 and 4 are formed on an inner surface of a front glass substrate 11, and address electrodes 5 are formed on an inner surface of a rear glass substrate 12. Sustained discharges are generated between each pair of the X and Y display electrodes 3 and 4 when the PDP operates. The X and Y display electrodes 3 and 4, and the address electrode 5 are formed in strips. When the front and rear glass substrates 11 and 12 are joined, the X and Y display electrodes 3 and 4 are perpendicular to the address electrode 5.

A front dielectric layer 14 and a protective layer 15 are sequentially deposited over the X and Y display electrodes 3 and 4. A rear dielectric layer 14' is formed over the address electrode 5, and barrier ribs 17 are formed on the rear dielectric layer 14', thus forming discharge cells 19, which are filled with inert gases including neon (Ne) and xenon (Xe). Also, predetermined portions of inner walls of the barrier ribs 17 are coated with a fluorescent layer 18. Bus electrodes 6 are formed on the X and Y display electrodes 3 and 4 to prevent increasing line resistance due to an increase in display electrode length.

In the operation of a PDP described above, a high level trigger voltage is applied to generate a discharge between the address electrode 5 and one of the X and Y display electrodes 3 and 4. The trigger voltage results in accumulation of positive ions in the front dielectric layer 14, thus generating discharge. When the trigger voltage is above a threshold voltage, discharge gases filled in the discharge cells 19 become plasmas due to the discharge between the address electrode 5 and the X or Y display electrode 3 or 4, and the discharge can be stably maintained. In such a sustained discharge state, ultraviolet rays collide against the fluorescent layer 18, thus causing light emission, which enables pixels of the respective discharge cells 19 to display an image.

FIG. 2 shows a plan view of X display electrodes 22, Y display electrodes 23, first bus electrodes 24, and second bus electrodes 25 formed in strips on an inner surface of a front glass substrate 21. Referring to FIG. 2, the X and Y display electrodes 22 and 23, which are transparent, are arranged in parallel. The first and second bus electrodes 24 and 25 are formed on the X and Y display electrodes 22 and 23, respectively. The first and second bus electrodes 24 and 25 extend to an edge of the front glass substrate 21 and connect to an external circuit (not shown) via a flexible printed cable (not shown). Each of the first bus electrodes 24 includes an extended part 24*a*, extending along the X display electrode 22, a slanted part 24*b*, formed along a right edge of the front glass substrate 21, and a connecting part 24*c*, connected to the external circuit. Although not shown in the drawings, each of the second bus electrodes 25 formed on the Y display electrodes 23 includes a slanted part formed along a left edge of the front glass substrate 21 and a connecting part.

Referring to FIG. 2, a width w1 of the extended part 24*a* is substantially equal to a width w2 of the slanted part 24*b*, and a width w3 of the connecting part 24*c* is greater than the widths w1 and w2. The widths w1 and w2 are typically about 70 to 100 μm, and their pitches are about 0.1 to 1.1 mm. In contrast, the width w3 of the connecting part 24*c* is typically about 200 to 300 μm and its pitch is about 0.4 to 0.6 mm.

A conventional PDP with bus electrodes such as those shown in FIG. 2 may have the following disadvantages. A PDP typically includes an ElectroMagnetic Interface (EMI) filter for shielding electromagnetic waves. The EMI filter is installed a predetermined distance from a front of a front glass substrate, thus forming a gap between the EMI filter and the front glass substrate. This gap may allow a user to see the slanted parts 24*b* with the naked eye. Further, formation of these slanted parts may result in an increase in bus electrode length, thus increasing electrical resistance.

To solve this problem, non-light emitting regions of a dielectric layer, such as the front dielectric layer 14 of FIG. 1, may be colored black. However, this requires an additional coloring process for the PDP manufacturing process without preventing an increase in electrical resistance due to an increase in the lengths of bus electrodes.

U.S. Pat. No. 5,952,782 suggests coating an edge of a substrate with a sealing film. However, in this case, slanted parts of a bus electrode may be partially coated with the sealing film, and thus, the coating is not helpful in improving shapes of the slanted parts and reducing electrical resistance.

SUMMARY OF THE INVENTION

Accordingly, the present invention is directed to a plasma display panel (PDP) that substantially obviates one or more of the problems due to limitations and disadvantages of the related art.

The present invention provides a PDP with an improved bus electrode structure.

The present invention also provides a PDP in which shapes of slanted parts of bus electrodes are improved without requiring any additional manufacturing process.

Additional features of the invention will be set forth in the description which follows, and in part will be apparent from the description, or may be learned by practice of the invention.

The present invention discloses a plasma display panel comprising a substrate, X display electrodes and Y display electrodes that are disposed in parallel on an inner surface of the substrate; bus electrodes including extended parts formed on the X and Y display electrodes, slanted parts formed along an edge of the substrate, extending from the respective extended parts and inclined with respect to the extended parts at a predetermined angle, and connecting parts extending from the slanted parts, a width of at least one portion of the slanted part being greater than a width of the extended part.

The present invention also discloses a plasma display panel comprising a front and rear glass substrates with X and Y display electrodes that are disposed in parallel on an inner surface of the front glass substrate. Bus electrodes have extended parts formed on the X and Y display electrodes, slanted parts formed along an edge of the front glass substrate, extending from the respective extended parts and inclined with respect to the extended parts at a predetermined angle, and connecting parts extending from the slanted parts. A width of at least one portion of the slanted part being greater than a width of the extended part. A first dielectric layer covers the X display electrodes, the Y display electrodes, and the bus electrodes. Address electrodes are formed on an inner surface of the rear glass substrate and are perpendicular to the X and Y display electrodes. A second dielectric layer covers the address electrodes, and barrier ribs are formed on the second dielectric layer. A red, green, and blue fluorescent layer id disposed between the barrier ribs, and an electromagnetic interface (EMI) filter is installed in front of the front glass substrate.

The present invention also discloses a plasma display panel comprising a substrate with X and Y display electrodes that are disposed in parallel on an inner surface of the substrate. Bus electrodes have extended parts formed on the X and Y display electrodes, slanted parts formed along an edge of the substrate, extending from the respective extended parts and inclined with respect to the extended parts at a predetermined angle, and connecting parts is extending from the slanted parts, wherein a width of at least one portion of a slanted part is greater than widths of other portions of the slanted part.

The present invention also discloses a plasma display panel comprising a substrate with X and Y display electrodes that are disposed in parallel on an inner surface of the substrate. Bus electrodes have extended parts formed on the X and Y display electrode, horizontal parts formed along an edge of the substrate and extending from the extended parts in a horizontal direction, slanted parts extending from the horizontal parts and inclined with respect to the horizontal parts at a predetermined angle, and connecting parts extending from the slanted parts, wherein widths of a horizontal part and at least one portion of the slanted part being greater than a width of the extended part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Reference will now be made in detail to an embodiment of the present invention, example of which is illustrated in the accompanying drawings.

Figure 1:
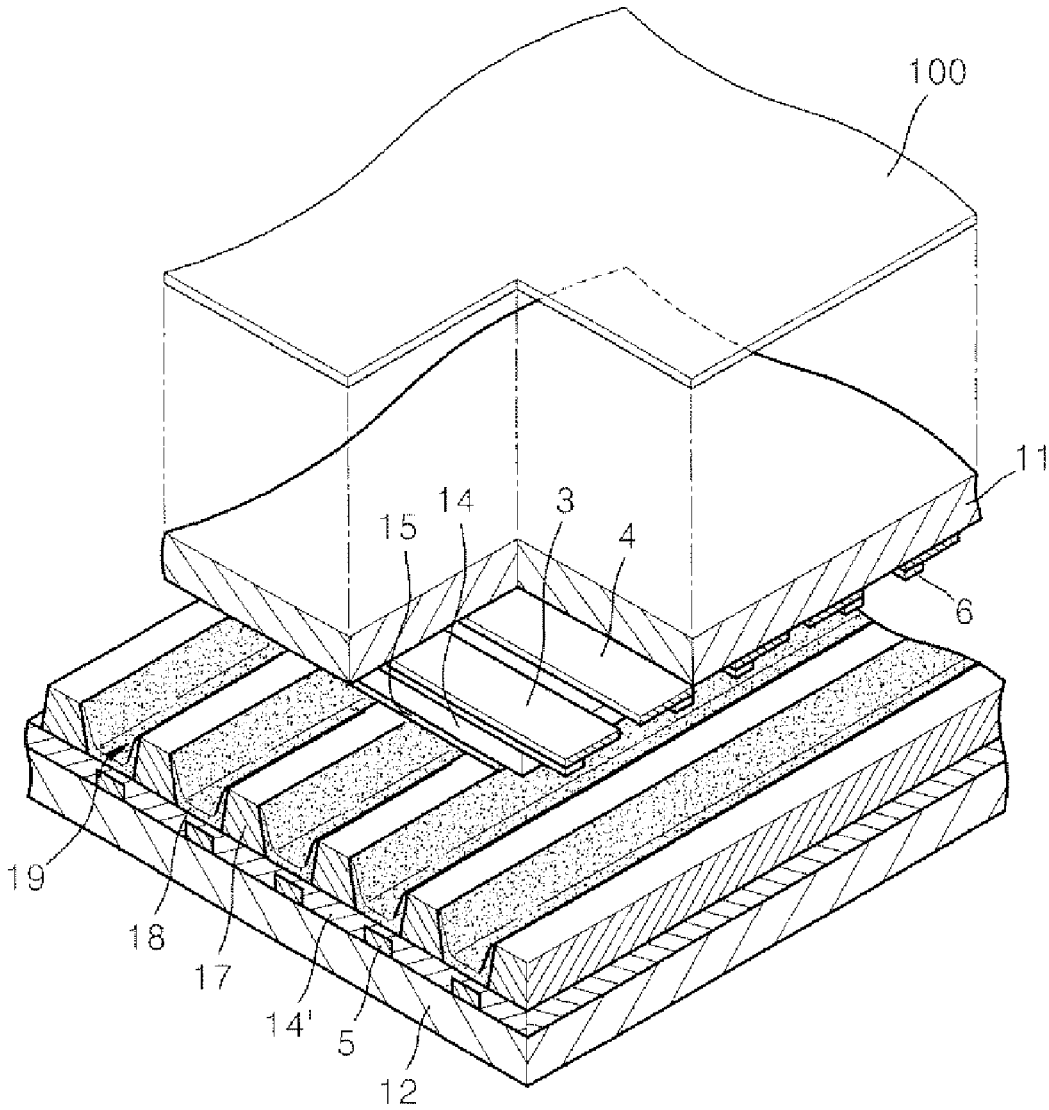
FIG. 1 (PRIOR ART)
FIG. 1 shows an exploded view of a conventional plasma display panel (PDP).

Exemplary embodiments of the plasma display panel (PDP) of the present invention have similar features as the conventional PDP of FIG. 1. As shown in FIG. 1, a PDP according to an exemplary embodiment of the present invention includes: front and rear glass substrates 11 and 12; X and Y display electrodes 3 and 4 that are arranged in parallel strips on an inner surface of the front glass substrate 11; bus electrodes 6 formed on the X and Y display electrodes 3 and 4; a first dielectric layer 14 that covers the X and Y display electrodes 3 and 4 and the bus electrodes 6; a protective layer 15 that covers the first dielectric layer 14; address electrodes 5 formed on an inner surface of the rear glass substrate 12 and perpendicular to the X and Y display electrodes 3 and 4; a second dielectric layer 14' that covers the address electrodes 5; barrier ribs 17 formed on the second dielectric layer 14'; and a red, green, and blue fluorescent layer 18 coated between the barrier ribs 17.

As shown in FIG. 1, an ElectroMagnetic Interference (EMI) filter 100 may also be installed on the front glass substrate 11. The type of EMI filter 100 is not limited. For example, the EMI filter 100 may be a well-known EMI filter manufactured by forming transparent electrodes in webs on a glass substrate and grounding the transparent electrodes to a case (not shown). The EMI filter 100 grounds electromagnetic waves generated by the PDP via its grounded transparent electrodes, thereby preventing the waves from directly heading toward a viewer.

Figure 3:
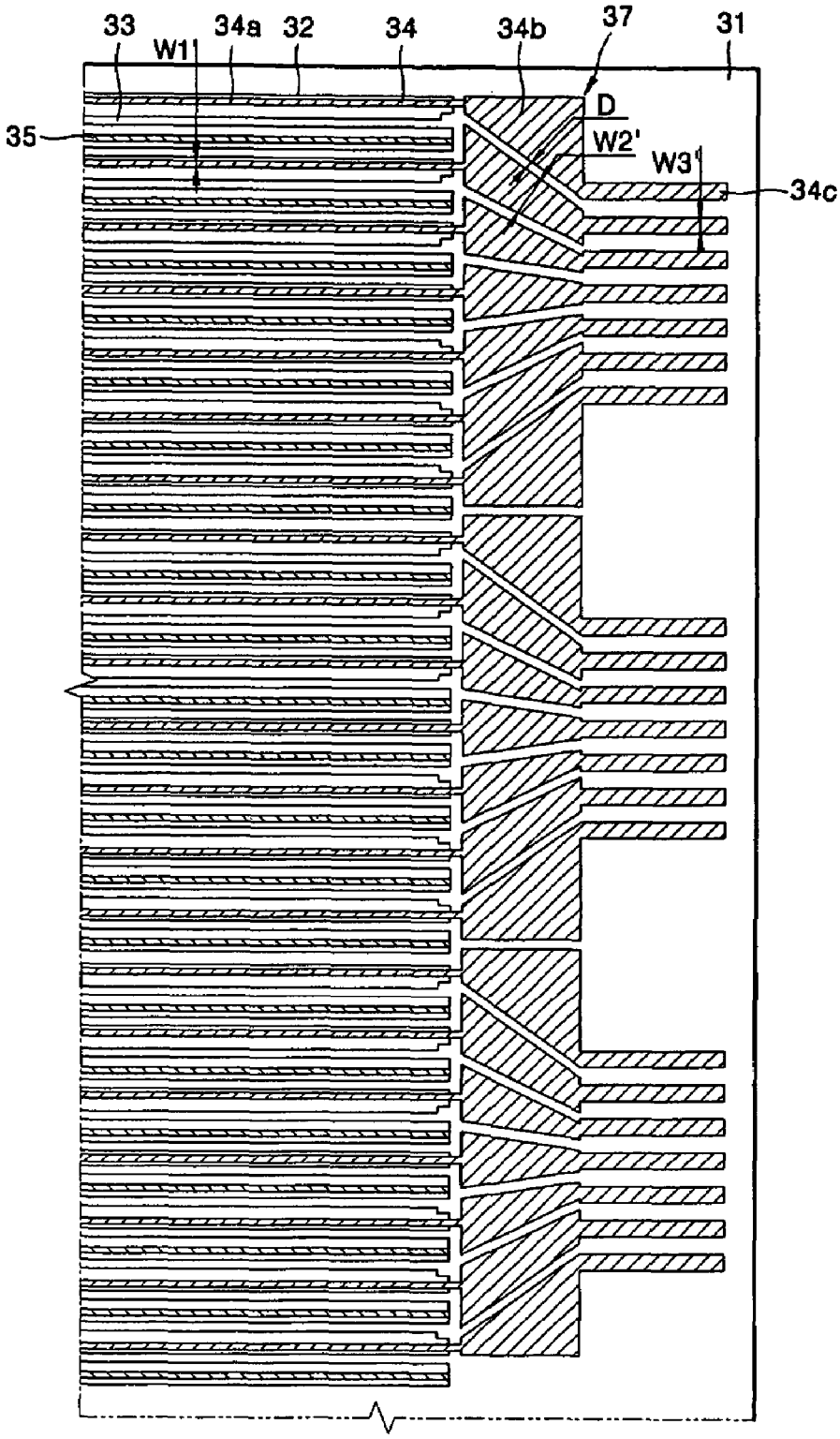
FIG. 3 shows a plan view of electrodes formed on an inner surface of a front glass substrate of a PDP according to an exemplary embodiment of the present invention.

FIG. 3 shows a plan view of X display electrodes 32, Y display electrodes 33, first bus electrodes 34, and second bus electrodes 35 formed in strips on an inner surface of a front glass substrate 31 of a PDP according to an exemplary embodiment of the present invention. Referring to FIG. 3, pairs of X and Y display electrodes 32 and 33 are formed in parallel on the inner surface of the front glass substrate 31. The first bus electrodes 34 and the second bus electrodes 35 are formed on the X display electrodes 32 and the Y display electrodes 33, respectively. Each of the first bus electrodes 34 includes an extended part **34*a* extending along the X display electrode 32; a slanted part 34*b* connected to the extended parts 34*a* and formed in non-light emitting regions of the PDP; and a connecting part 34*c* connected to the slanted part 34*b* and extending to an edge of the front glass substrate 31. The connecting parts 34*c*** are connected to an external circuit (not shown) via a flexible printed cable (not shown).

Like the first bus electrodes 34, each of the second bus electrodes 35 may also include an extended part, a slanted part, and a connecting part. The slanted parts and connecting parts of the second bus electrodes 35 are arranged along a left edge of the front glass substrate 31, and therefore, their illustrations are omitted in the drawings.

According to an exemplary embodiment of the present invention, widths of portions of the slanted parts of respective X and Y bus electrodes may be greater than those of their extended parts and connecting parts. A distance between adjacent slanted parts is preferably minimized, but within a range that does not cause electrical interferences between the X and Y bus electrodes. In other words, areas of the slanted parts are preferably maximized so that a distance between adjacent slanted parts are minimized and thus cannot be noticed by the naked eye via an EMI filter installed in the PDP.

Figure 2:
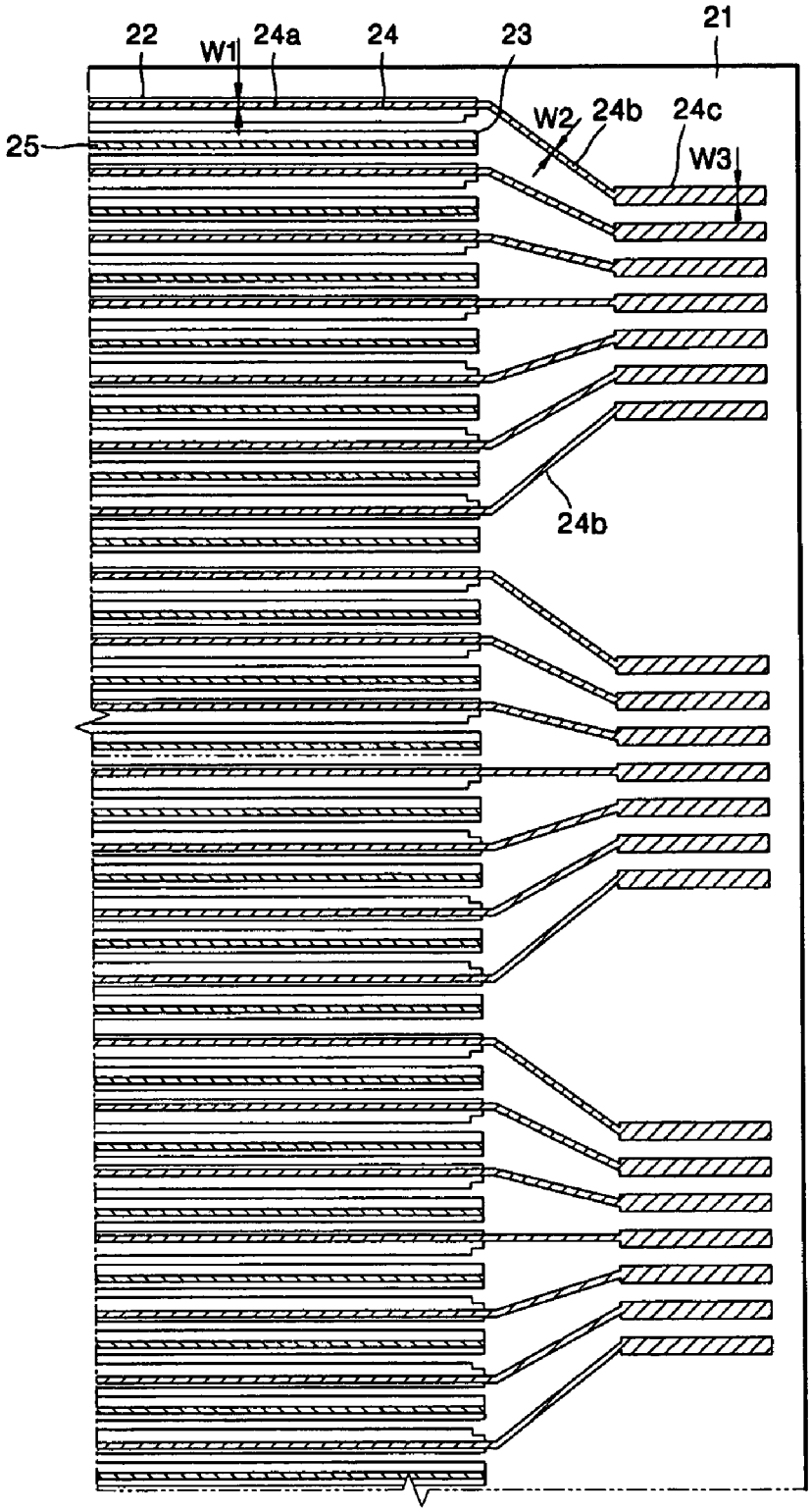
FIG. 2 (PRIOR ART)
FIG. 2 shows a plan view of electrodes formed on an inner surface of a front glass substrate of a conventional PDP.

In FIG. 3, w1', w2', and w3' denote a width of the extended part 34*a*, the slanted part 34*b*, and the connecting part 34*c*, respectively. As is apparent from FIG. 3, the width w2' of the slanted part 34*b* is greater than the width w1' of the extended part 34*a* and the width w3' of the connecting part 34*c*. The width w1' of the extended part 34*a* and the width w3' of the connecting part 34*c* may be equal to the width w1 of the extended part 24*a* and the width w3 of the connecting part 24*c* of the conventional PDP of FIG. 2. However, as compared to the slanted part 24*b* of the conventional PDP of FIG. 2, the area of the slanted part 34*b* is increased due to its width w2' being widened, and therefore, a gap between adjacent slanted parts 34*b* is minimized so that it may not be noticed by the naked eye. In FIG. 3, D denotes a gap between adjacent slanted parts 34*b*. The gap D is determined so that adjacent first bus electrodes 34 can perform bus electrode functions without electrically influencing each other and so that the slanted parts 34*b* appear as a long, seamless black strip to the naked eye. In this exemplary embodiment, the gap D is narrower than the width w2' of the slanted part 34*b* and it is set at a range of about 50 μm to about 200 μm, preferably, about 80 μm to about 100 μm.

Reference numeral 37 denotes a slanted part 34*b* nearest the top of the front glass substrate 31. The slanted part 37 is shaped to correspond to that of a corner of the front glass substrate 31. In other words, a top of the slanted part 37 is parallel with the front glass substrate 31 and its sides are perpendicular to its top. Accordingly, the slanted parts 34*b* may be seen by the naked eye as a long, seamless black strip in the vertical direction of the front glass substrate 31.

Similarly, although not shown in the drawings, slanted parts of the second bus electrodes 35 on the Y display electrode 33 may be formed along a left edge of the front glass substrate 31, the shapes of the slanted parts being equivalent to those of the slanted parts 34*b*. Accordingly, the slanted parts of the first and second bus electrodes 34 and 35 arranged along the right and left edges of the front glass substrate 31 may appear as long, seamless black strips in the vertical direction. Also, when such slanted parts are viewed by the naked eye, the PDP's appearance may improve, and an increase in bus electrode width may result in electrical resistance reduction.

An electrical field may be concentrated on a part of a bus electrode, such as the slanted part 37, which has a part with a right angle. A corner of the slanted part 37 may be rounded to solve this problem. This may prevent the electrical field from being concentrated thereon while maintaining the black strip bus electrode formation.

Figure 4:
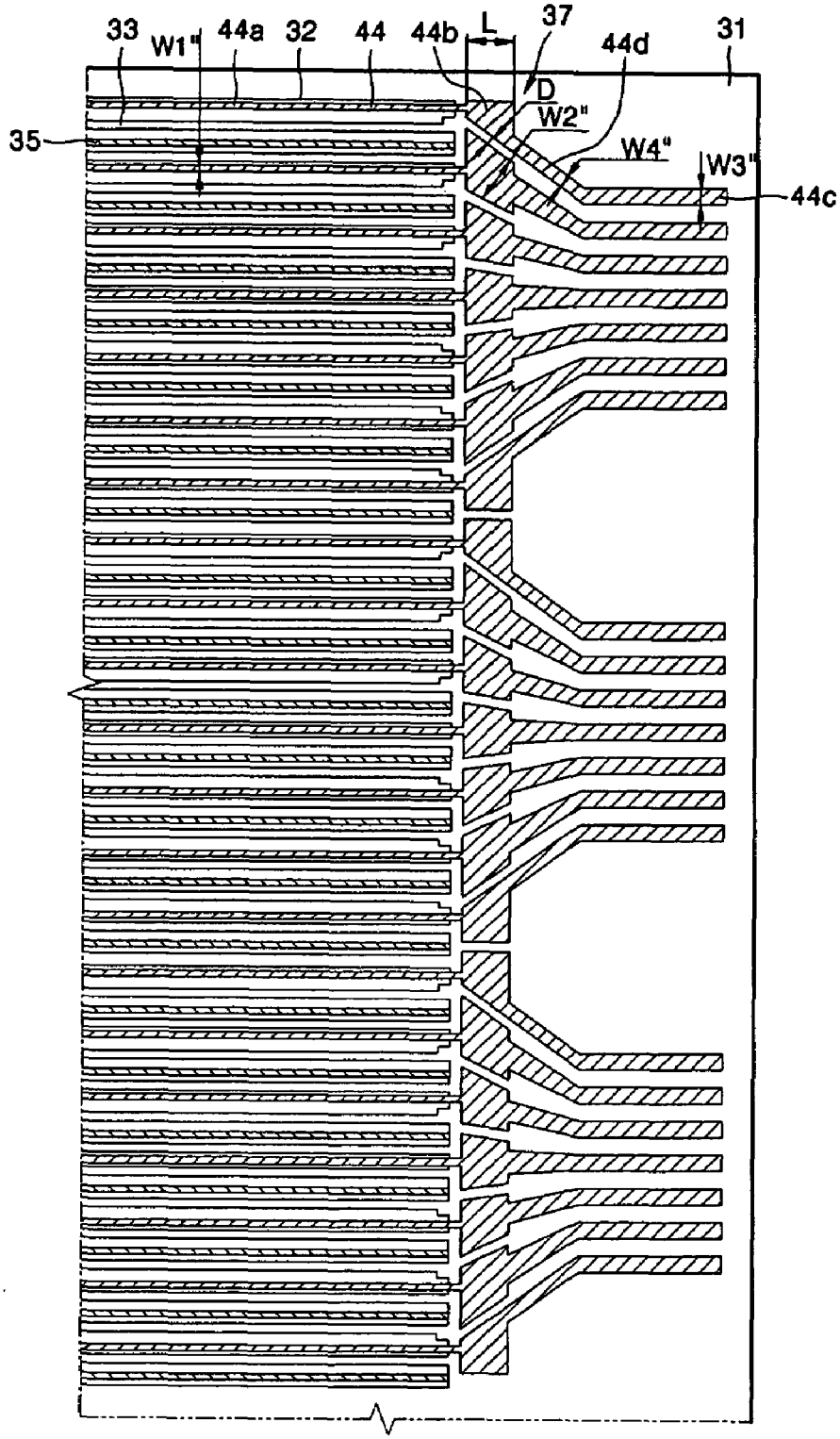
FIG. 4 shows a plan view of electrodes formed on an inner surface of a front glass substrate of a PDP according to a second exemplary embodiment of the present invention.

FIG. 4 shows a plan view of X display electrodes 32, Y display electrodes 33, first bus electrodes 44, and second bus electrodes 35 arranged in strips on an inner surface of a front glass substrate 31 of a PDP according to a second exemplary embodiment of the present invention. The X and Y display electrodes 32 and 33 of FIG. 4 are similar to the X and Y display electrodes 32 and 33 of FIG. 3. Elements that are the same as those shown in FIG. 3 are indicated with the same reference numerals, and their description is omitted here.

Referring to FIG. 4, each of the first X bus electrodes 44 includes an extended part 44*a*, a slanted part 44*b*, and a connecting part 44*c*. A width w2" of a portion of the slanted part 44*b*, which falls within a range of a predetermined line L, is greater than a width w3" of the connecting part 44*c*, but a width w4" of another portion of the slanted part 44*d* is equivalent to the width w3" of the connecting part 44*c*. A width of the extended part 44*a* is indicated by w1". That is, as is apparent from FIG. 4, the width w2" is greater than the width w4", the width w1", and the width w3". The width w1" of the extended part 44*a* and the width w3" of the connecting part 44*c*. may be equivalent to the width w1 of the extended part 24*a* and the width w3 of the connecting part 24*c* of the conventional PDP of FIG. 2, respectively. The width w4" of the slanted part 44*d* is substantially equal to the width w1" and the width w3". Accordingly, widths of portions of the slanted parts 44*b* of FIG. 4 may be greater than that of other portions of the slanted parts 44*d*, thus making the slanted parts 44*b* appear as a long seamless black strip.

Figure 5:
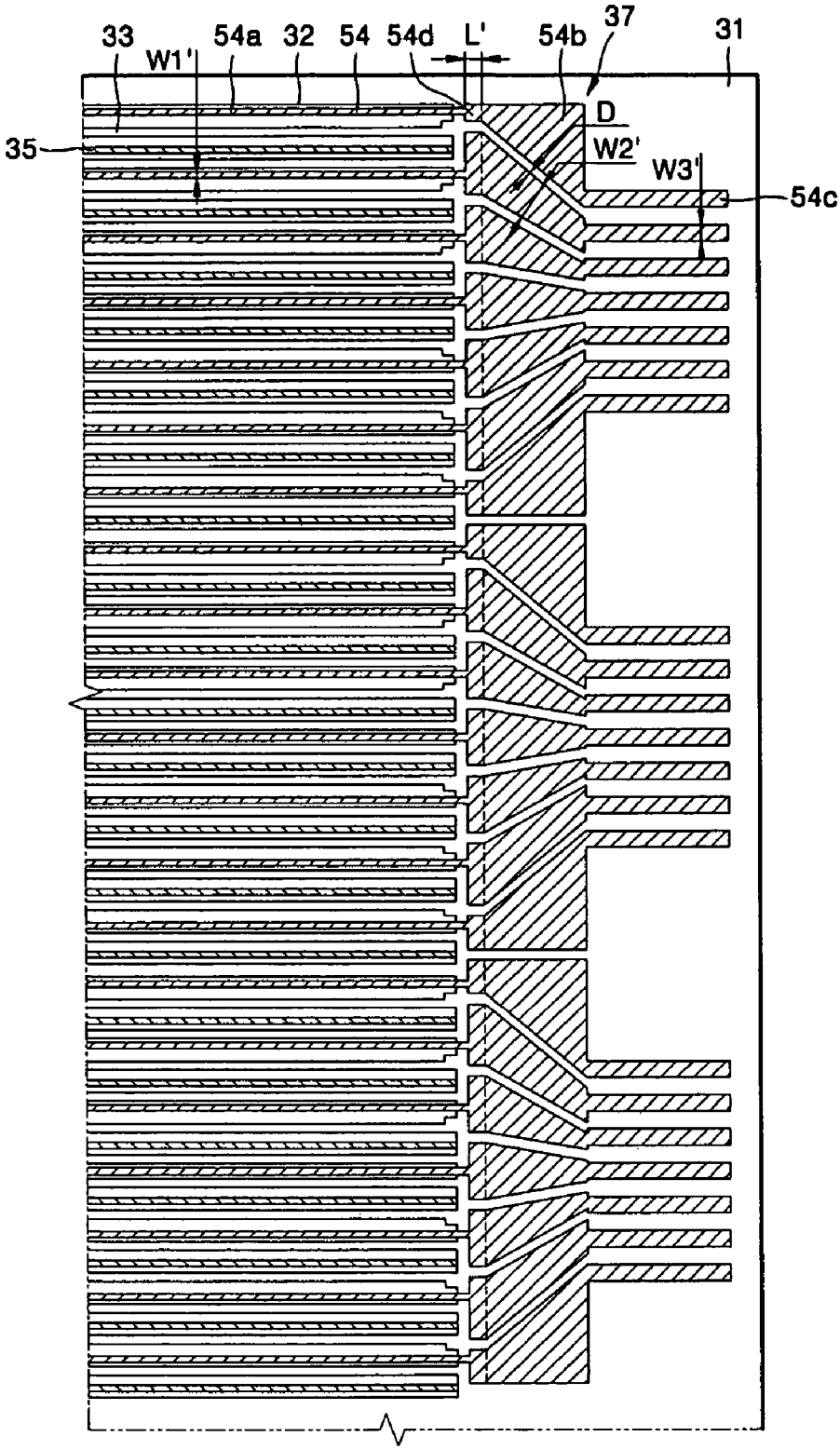
FIG. 5 shows a plan view of electrodes formed on an inner surface of a front glass substrate of a PDP according to a third exemplary embodiment of the present invention.

FIG. 5 shows a plan view of X display electrodes 32, Y display electrodes 33, first bus electrodes 54, and second bus electrodes 35 aligned in strips on an inner surface of a front glass substrate 31 of a PDP according to a third exemplary embodiment of the present invention. The X and Y display electrodes 32 and 33 of FIG. 5 are similar to the X and Y display electrodes 32 and 33 of FIG. 3. Elements that are the same as those shown in FIG. 3 are indicated with the same reference numerals and their description is omitted here.

Referring to FIG. 5, each of the first bus electrodes 54 includes an extended part 54*a*, a slanted part 54*b*, a connecting part 54*c*, and a horizontal part 54*d*, which is located between the extended part 54*a*and the slanted part 54*b*. The horizontal part 54*d*extends from the extended part 54*a*in the horizontal direction, and its width is greater than a width w1' of the extended part 54*a*. Also, the width of the horizontal part 54*d*is equal to that of the slanted part 54*b* at a point where it meets the slanted part 54*b*, but it may be narrower than the width of the other portion of the slanted part 54*b*. The horizontal part 54*b* falls within a range of a predetermined line L'.

Referring to FIG. 5, the widths of the slanted part 54*b* may be greater than the widths of the extended part 54*a*and the connecting part 54*c*. Alternatively, as shown in FIG. 4, a width of a portion of the slanted part 54*b* may be greater than the widths of the extended part 54*a* and the connecting part 54*c* within a range of a predetermined horizontal line, and widths of the other portions of the slanted part 54*b* may be equal to that of the connecting part 54*c*. That is, each of the first bus electrodes 54 may further include a part similar to the horizontal part 44*d* of FIG. 4.

As described above, a PDP according to exemplary embodiments of the present invention includes bus electrodes that are formed to appear as a long seamless strip along both sides of a substrate when a user views them on the front of the PDP, thereby improving the PDP's appearance. Also, electrical resistance may be reduced by increasing widths of slanted parts of bus electrodes.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a substrate;

X display electrodes and Y display electrodes that are disposed in parallel on an inner surface of the substrate;

bus electrodes including extended parts formed on the X and Y display electrodes, slanted parts formed along an edge of the substrate, extending from the respective extended parts and inclined with respect to the extended parts at a predetermined angle, and connecting parts extending from the slanted parts, a width of at least one portion of the slanted part being greater than a width of the extended part, wherein a distance between adjacent slanted parts is in the range of 50 to 200 m.

2. The PDP of claim 1, wherein the distance between adjacent slanted parts is in the range of 80 to 100 μm.

3. The PDP of claim 1, wherein a width of the slanted part is greater than a width of the connecting part.

4. A plasma display panel (PDP), comprising:

a substrate;

X display electrodes and Y display electrodes that are disposed in parallel on an inner surface of the substrate;

bus electrodes including extended parts formed on the X and Y display electrodes, slanted parts formed along an edge of the substrate, extending from the respective extended parts and inclined with respect to the extended parts at a predetermined angle, and connecting parts extending from the slanted parts, a width of at least one portion of the slanted part being greater than a width of the extended part, wherein the slanted parts appear as a long, vertical strip.

5. A plasma display panel (PDP), comprising:

a substrate;

X display electrodes and Y display electrodes that are disposed in parallel on an inner surface of the substrate;

bus electrodes including extended parts formed on the X and Y display electrodes, slanted parts formed along an edge of the substrate, extending from the respective extended parts and inclined with respect to the extended parts at a predetermined angle, and connecting parts extending from the slanted parts, a width of at least one portion of the slanted part being greater than a width of the extended part, wherein the slanted parts have a first portion that extends from the extended part to a second portion of the slanted part, and the second portion extends from the first portion of the slanted part to the connecting part;

wherein a width of the first portion is greater than a width of the second portion, the extended part and the connecting part; and the width of the second portion equals the width of the connecting part.

6. A plasma display panel, comprising:

a substrate;

X display electrodes and Y display electrodes that are disposed in parallel on an inner surface of the substrate;

bus electrodes including extended parts formed on the X and Y display electrodes, slanted parts formed along an edge of the substrate, extending from the respective extended parts and inclined with respect to the extended parts at a predetermined angle, and connecting parts extending from the slanted parts, wherein a width of at least one portion of a slanted part being greater than widths of other portions of the slanted part.

7. A plasma display panel (PDP), comprising:

a substrate;

X display electrodes and Y display electrodes that are disposed in parallel on an inner surface of the substrate;

bus electrodes including extended parts formed on the X and Y display electrodes, horizontal parts formed along an edge of the substrate and extending from the extended parts in a horizontal direction, slanted parts extending from the horizontal parts and inclined with respect to the horizontal parts at a predetermined angle, and connecting parts extending from the slanted parts, wherein widths of a horizontal part and at least one portion of the slanted part being greater than a width of the extended part, wherein a width of the horizontal part is equal to a width of the slanted part at a point where the horizontal part and the slanted part meet, and wherein a width of the slanted part is greater than a width of the horizontal part.

8. A plasma display panel (PDP), comprising:

a substrate;

X display electrodes and Y display electrodes that are disposed in parallel on an inner surface of the substrate;

bus electrodes including extended parts formed on the X and Y display electrodes, horizontal parts formed along an edge of the substrate and extending from the extended parts in a horizontal direction, slanted parts extending from the horizontal parts and inclined with respect to the horizontal parts at a predetermined angle, and connecting parts extending from the slanted parts, wherein widths of a horizontal part and at least one portion of the slanted part being greater than a width of the extended part, wherein the slanted parts have a first portion that extends from the horizontal part to a second portion of the slanted part, and the second portion extends from the first portion of the slanted part to the connecting part;

wherein a width of the first portion is greater than a width of the second portion, the extended part, the horizontal part, and the connecting part; and the width of the second portion equals the width of the connecting part.

* * * * *